US007426759B2

(12) United States Patent
Donaldson

(10) Patent No.: US 7,426,759 B2
(45) Date of Patent: Sep. 23, 2008

(54) ADJUSTABLE BED AND METHODS THEREOF

(76) Inventor: Mary J. Donaldson, 324 Caracus Dr., Las Vegas, NV (US) 89145

( * ) Notice: Subject to any disclaimer, the term of this patent is extended or adjusted under 35 U.S.C. 154(b) by 315 days.

(21) Appl. No.: 11/173,592

(22) Filed: Jul. 1, 2005

(65) Prior Publication Data

US 2007/0000055 A1 Jan. 4, 2007

(51) Int. Cl.
*A61G 7/008* (2006.01)

(52) U.S. Cl. ..... 5/607; 5/424; 5/616

(58) Field of Classification Search ..... 5/607, 5/609, 608, 600, 424, 616
See application file for complete search history.

(56) References Cited

U.S. PATENT DOCUMENTS 3,900,906 A * 8/1975 Berthelsen ..... 5/608
4,006,499 A * 2/1977 Young ..... 5/608
4,071,222 A 1/1978 Wright
4,558,857 A * 12/1985 Heller ..... 5/618
4,586,492 A * 5/1986 Manahan ..... 601/90
5,103,511 A * 4/1992 Sequin ..... 5/607
5,224,228 A * 7/1993 Larrimore ..... 5/613
6,658,680 B2 12/2003 Osborne et al.
6,668,408 B2 12/2003 Ferrand et al.
6,691,349 B2 2/2004 Blevins
6,772,462 B1 8/2004 Harrell

* cited by examiner

*Primary Examiner*—Alexander Grosz
(74) *Attorney, Agent, or Firm*—David Landman; Landaleip, Inc.

(57) ABSTRACT

An adjustable bed comprises a stationary bed frame and a movable bed frame. A portion of the stationary bed frame is coupled to a portion of a plurality of actuator devices and a portion of the movable bed frame is coupled to a portion of the actuator devices. A power supply coupled to the actuator devices activates the actuator devices. At least one of the actuator devices comprises a safety switch to prevent unauthorized use of the actuator devices, and a toggle switch to elevate and lower at least one actuator of the actuator devices. A caregiver unlocks the safety switch, activates the actuator devices and guides a person transversely from one side of a mattress located on the movable bed frame to a second side of the mattress thereby permitting access to a portion of the person that was previously inaccessible.

19 Claims, 4 Drawing Sheets

ADJUSTABLE BED AND METHODS THEREOF

FIELD OF THE INVENTION

This invention relates generally to beds, and more specifically, to an adjustable bed adapted to relocate a patient from a side of the adjustable bed to a second side of the adjustable bed, and to provide methods for safely moving the patient from a side of the adjustable bed to a second side of the adjustable bed, thereby permitting at least one caregiver of the patient to access a previously inaccessible portion of the patient conveniently.

BACKGROUND OF THE INVENTION

In the past, a number of electronically adjustable hospital beds have been disclosed, which permit elevating and lowering of a patient longitudinally (i.e. in a head to foot direction). For example, Wright, U.S. Pat. No. 4,071,222 disclosed a lifting platform (such as a hospital bed), which is supported from a base by a pair of X-linkages and permits head to foot motion of the platform. More recently, Osborne, et al., U.S. Pat. No. 6,658,680 disclosed yet another bed capable of head to foot longitudinal motion. Even more recently, several other U.S. patents, such as U.S. Pat. No. 6,772,462, U.S. Pat. No. 6,691,349 and U.S. Pat. No. 6,668,408 have also disclosed beds capable of head to foot longitudinal motion. These disclosures also suggest that it is desirable to be able to move a patient conveniently from one bed to another. Methods for doing this include lifting the bed so that the bed remains horizontal and sliding the patient across from one bed to another bed.

Often patients need to be moved from side to side in a bed. Such movement is desirable for a number of reasons including the need to change bed linen while the patient is still in the bed, the need to prevent bedsores, which can lead to health complications for the patient, the need to dress an inaccessible wound and the need to change the patient's clothing. Clearly, a longitudinal movement of the patient in a bed would not accomplish the above-noted requirements. Currently, the only way to accomplish these requirements is to physically lift the patient out of the bed or turn the patient over with more than a single caregiver usually needed to turn the patient. In addition, such physical manipulation usually causes the patient some discomfort and may aggravate an injury.

For the foregoing reasons, there is a need to provide an improved adjustable bed, which would accomplish the above-noted needs for the patient and preferably only requires one caregiver.

SUMMARY OF THE INVENTION

An adjustable bed adapted to permit transverse (side-to-side) motion of a patient across the bed rather than in a longitudinal (head-to-foot) direction is clearly desirable. In order to accommodate all the above requirements, the adjustable bed has a simple construction with a number of safety features incorporated into the controls and the structure of the adjustable bed. Moreover, the improved adjustable bed is economical to build since it requires only minor modifications of a conventional electrical hospital bed. The improved adjustable bed comprises a stationary (first) bed frame coupled to a portion of each one of a plurality of actuator devices and a portion of each one of the plurality of actuator devices coupled to a movable (second) bed frame. When at least one actuator device of the plurality of actuator devices slowly elevates one side of the movable bed frame relative to the stationary bed frame of the adjustable bed, the patient gently rolls from the elevated side of the movable bed frame to a second side of the movable bed frame of the adjustable bed.

Accordingly, it is an object of this invention to provide an improved adjustable bed adapted to relocate a person located on a portion of the adjustable bed from one side of the adjustable bed to a second side of the adjustable bed by elevating one side of a portion of a movable bed frame relative to a stationary bed frame of the adjustable bed.

It is a further object of this invention to provide an improved adjustable bed having safety control features while elevating a portion of a movable bed frame of the adjustable bed on one side relative to a stationary bed frame of the adjustable bed.

It is still a further object of this invention to provide an improved adjustable bed adapted to control elevation of a portion of one side of a movable bed frame relative to a stationary bed frame of the adjustable bed operable by a sole caregiver to provide individualized care to a person confined to the adjustable bed.

It is a further object of this invention to provide an improved adjustable bed having a stationary bed frame coupled to a portion of each one of a plurality of actuator devices and a movable bed frame coupled to a portion of each one of the plurality of actuator devices, thereby permitting controlled elevation of a portion of one side of the movable bed frame relative to the stationary bed frame of the adjustable bed.

It is a still further object of this invention to provide a method of safely moving a person from one side of an improved adjustable bed to a second side of the adjustable bed by elevating one side of a portion of a movable bed frame relative to a stationary bed frame of the adjustable bed, thereby permitting at least one caregiver of the person to conveniently access a previously inaccessible portion of the person.

PREFERRED EMBODIMENTS OF THE INVENTION

In accordance with one embodiment of this invention, an adjustable bed is disclosed. The adjustable bed comprises, in combination a first bed frame and a second bed frame, a plurality of actuator devices, a portion of the first bed frame coupled to a portion of each one of the plurality of actuator devices and a portion of the second bed frame coupled to a portion of each one of the plurality of actuator devices; and a power supply coupled to the plurality of actuator devices providing power to selectively elevate a side of the second bed frame thereby relocating a person resting on a mattress located on the second bed frame transversely from a first side to a second side of the mattress.

In accordance with another embodiment of this invention, an adjustable bed is disclosed. The adjustable bed comprises, in combination a stationary bed frame and a movable bed frame; a first pair of actuator devices located on a side of the adjustable bed and a second pair of actuator devices located on an opposite side of the adjustable bed, a portion of the stationary bed frame coupled to a portion of each one of the first pair and the second pair of actuator devices and a portion of the movable bed frame coupled to a portion of each one of the first pair and the second pair of actuator devices; and a power supply coupled to at least one of the first pair of actuator devices and to at least one of the second pair of actuator devices providing power to selectively elevate a side of the movable bed frame thereby relocating a person resting on a mattress located on the movable bed frame transversely from a first side to a second side of the mattress.

In accordance with another embodiment of this invention, a method for safely moving a person from a side of a bed to a second side of the bed is disclosed. The method comprises the steps of providing an adjustable bed comprising a first bed frame and a second bed frame; providing the adjustable bed comprises a plurality of actuator devices, a portion of the first bed frame coupled to a portion of each one of the plurality of actuator devices and a portion of the second bed frame coupled to a portion of each one of the plurality of actuator devices; and providing the adjustable bed comprises a power supply coupled to the plurality of actuator devices to selectively elevate a side of the second bed frame thereby relocating a person resting on a mattress located on the second bed frame transversely from a first side to a second side of the mattress.

The foregoing and other objects, features, and advantages of the invention will be apparent from the following, more detailed description of the preferred embodiments of the invention, as illustrated in the accompanying drawings.

BRIEF DESCRIPTION OF THE DRAWINGS

FIG. 2A is a perspective view showing a footboard of the adjustable bed of FIG. 1 with one side of the movable bed frame elevated relative to the stationary bed frame.

DESCRIPTION OF THE INVENTION

In this disclosure the term a "first" bed frame is synonymous with the term a "stationary" bed frame and the term a "second" bed frame is synonymous with the term a "movable" bed frame.

Figure 1:
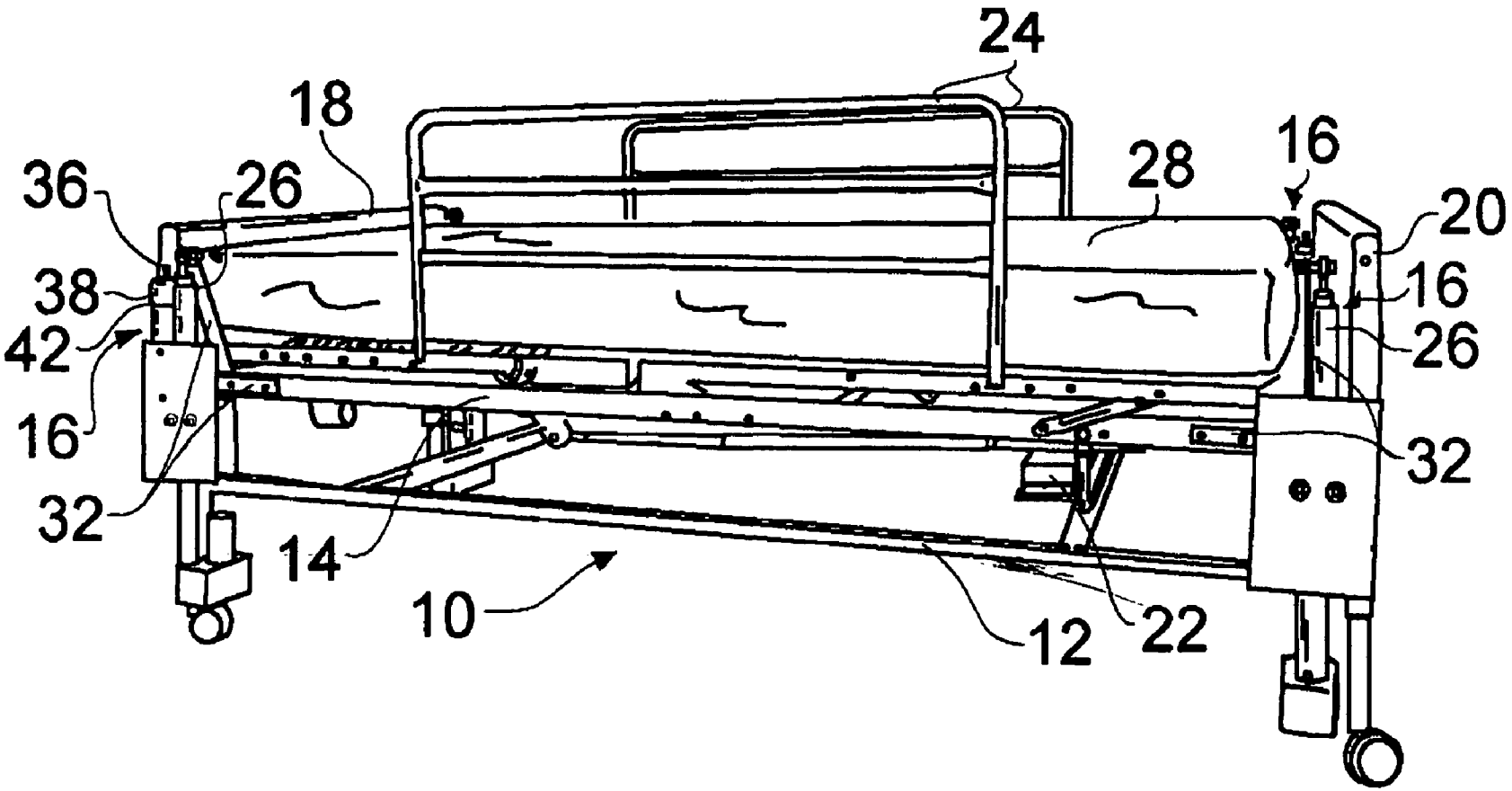
FIG. 1 is a perspective view of an adjustable bed having a portion of a stationary bed frame coupled to a portion of a plurality of actuator devices and a portion of a movable bed frame coupled to a portion of the plurality of actuator devices in accordance with this invention.

According to FIG. 1, an adjustable bed 10 comprises a first bed frame 12 and a second bed frame 14. The adjustable bed 10 further comprises a plurality of actuator devices 16 with each one of the actuator devices 16 comprising a variety of components (see FIG. 3, described below). A portion of the first bed frame 12 is coupled to a portion of each one of the actuator devices 16 and a portion of the second bed frame 14 is coupled to a portion of each one of the actuator devices 16 (see also FIGS. 2A, 2B and 3, described below).

A power supply 22 is coupled to the actuator devices 16 to provide power selectively to elevate a side of the second bed frame 14 thereby relocating a person resting on a mattress 28 located on the second bed frame 14 transversely from a first side to a second side of the mattress 28 (see FIGS. 2A and 2B, described below). The power supply 22 may be a 24 volt-DC power supply coupled to a conventional AC-power source (see FIG. 4, described below). Without any limitation to the scope of the present disclosure, it is understood that the power supply 22 may be either a DC or an AC power supply. For example, the power supply 22 may be an AC power source coupled to the actuator devices 16 or a rechargeable DC battery coupled to the actuator devices 16. When the power supply 22 is a DC battery, the adjustable bed 10 may be moved conveniently from one location to another location where an AC power source is not immediately available. Each one of the actuator devices 16 comprises an actuator 26. The actuator 26 selectively extends and retracts when powered by the power supply 22. A commercial example of a suitable linear electromechanical actuator 26 is manufactured by Duff-Norton Engineers, N.C., USA. Without limiting the scope of the specific features of the actuator 26 of the current disclosure, it is contemplated that the actuator 26 may be comprise either a solenoid, a hydraulic ram, electromechanical mechanism or a gear mechanism and the like.

Furthermore, the adjustable bed 10 comprises at least one safety rail 24 coupled to a portion of the second bed frame 14 to prevent the person from rolling off the mattress 28 when powering at least one actuator device 16 of the plurality of actuator devices 16. The safety rail 24 may be fixed in height or may be adjustable in height with a locking mechanism provided thereon to prevent the person from falling out of the adjustable bed 10 either when the adjustable bed 10 is in a static position or when elevating the adjustable bed 10. The adjustable bed 10 further comprises a headboard 18 and a footboard 20. A portion of the headboard 18 and a portion of the footboard 20 are coupled to a portion of the first bed frame 12 (see FIGS. 2A, 2B and 3, described below). The headboard 18 and the footboard 20 confine the person safely in the adjustable bed 10 when elevating a side of the second bed frame 14. It is understood that the headboard 18 and the footboard 20 may also confine the person safely when the adjustable bed 10 is in a static position.

Turning now to the actuator devices 16 of the adjustable bed 10, a portion (specifically a joint coupler 34) of each actuator 26 of the actuator devices 16 is coupled to an end of each of a plurality of brackets 32 (see FIG. 3, described below). A portion of the second bed frame 14 is coupled to an opposite end of each of the brackets 32 (see FIG. 3, described below). Thus, when each actuator 26 is activated by the power supply 22 each corresponding bracket 32 coupled to the corresponding joint coupler 34 of the corresponding actuator 26 slowly raises or lowers the side of the second bed frame 14. Preferably, each actuator 26 of the actuator devices 16 selectively elevates the side of the second bed frame 14 no greater than about 18 inches (about 46 centimeters). Each of the actuators 26 are capable of lifting about 600 pounds of weight. Without limiting the scope of the present disclosure, it is understood that the specific lifting capability of each actuator 26 may be less than or greater than 600 pounds of weight.

Furthermore, at least one actuator device 16 comprises a toggle switch 36 provided for selectively elevating and lowering one side of the second bed frame 14 relative to the first bed frame 12. The toggle switch 36 comprises a three-position double-pole-double throw (herein referred to as DPDT) switch (see FIG. 4, described below). The three positions of the toggle switch 36 regulate upwards motion, downwards motion and no motion (neutral) of each actuator 26. In one embodiment, one toggle switch 36 regulates power to a pair of actuator devices 16 located on one side of the adjustable bed 10 to elevate the side of the second bed frame 14. A second toggle switch 36 regulates power to a pair of actuator devices 16 located on an opposite side of the adjustable bed 10 to elevate an opposite side of the second bed frame 14.

At least one actuator device 16 further comprises a safety switch 38 to prevent unauthorized use of the actuator device 16. In one embodiment, the safety switch 38 requires a key provided by a caregiver to unlock the actuator device 16. Without limiting the scope of the present disclosure, it is contemplated that the "key" may be a conventional key corresponding to a conventional lock and key mechanism, a wireless key remotely activated by the caregiver or a credit card style key, and the like. Each of the toggle switch 36 and the safety switch 38 may be located on a portion of a switching cylinder 42 of each of the actuator devices 16 (see also FIGS. 3 and 4, described below), with each toggle switch 36 and each safety switch 38 being coupled to each actuator 26 of the actuator devices 16.

Specifically with reference to FIG. 1, a pair of actuator devices 16 is located on a side of the adjustable bed 10 and a second pair of actuator devices 16 is located on an opposite side of the adjustable bed 10. A portion of the stationary bed frame 12 is coupled to a portion of each one of the first pair and the second pair of actuator devices 16. A portion of the movable bed frame 14 is coupled to a portion of each one of the first pair and the second pair of actuator devices 16. Without limiting the scope of the present disclosure, it is understood that one actuator device 16 located on the side of the adjustable bed 10 and a second actuator device 16 located on the opposite side of the adjustable bed 10 may be equally effective in elevating a side of the second bed frame 14. The power supply 22 is coupled to at least one of the first pair of actuator devices 16 and to at least one of the second pair of actuator devices 16. The power supply 22 provides power to selectively elevate a side of the movable bed frame 14 thereby relocating a person resting on the mattress 28 located on the movable bed frame 14 transversely from a first side to a second side of the mattress 28. A first actuator 26 of the first pair of actuator devices 16 is coupled to a second actuator 26 of the first pair of actuator devices 16, both the first actuator 26 and the second actuator 26 elevating the movable bed frame 14 when activated by the power supply 22. The adjustable bed 10 comprises the safety rail 24 coupled to a portion of the movable bed frame 14 to prevent the person from rolling off the mattress 28 when powering at least one actuator device 16 of the first pair and the second pair of actuator devices 16. The adjustable bed further comprises a headboard 18 and a footboard 20. Both a portion of the headboard 18 and a portion of the footboard 20 are coupled to a portion of the stationary bed frame 12 to confine the person safely between the headboard 18 and the footboard 20 when elevating a side of the movable bed frame 14. At least one actuator device 16 of both the first pair and the second pair of actuator devices 16 comprises the toggle switch 36 and the safety switch 38. The toggle switch 36 selectively elevates and lowers a side of the second bed frame 14 relative to the first bed frame 12 and the safety switch 38 prevents unauthorized use of both the first pair and the second pair of actuator devices 16. The adjustable bed 10 further comprises a plurality of brackets 32. An end of each of the brackets 32 is coupled to a portion of each actuator 26 of the first pair and the second pair of actuator devices 16 and a portion of the second bed frame 14 is coupled to an opposite end of each of the brackets 32.

Figure 2A:
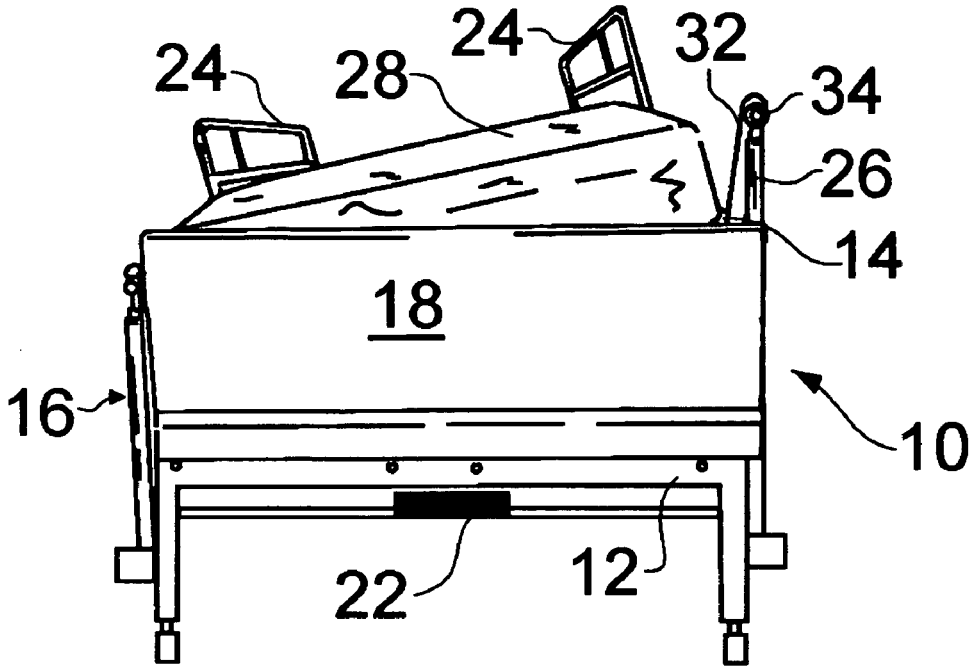
FIG. 2A is a perspective view showing a headboard of the adjustable bed of FIG. 1 with one side of the movable bed frame elevated relative to the stationary bed frame.
Figure 2B:
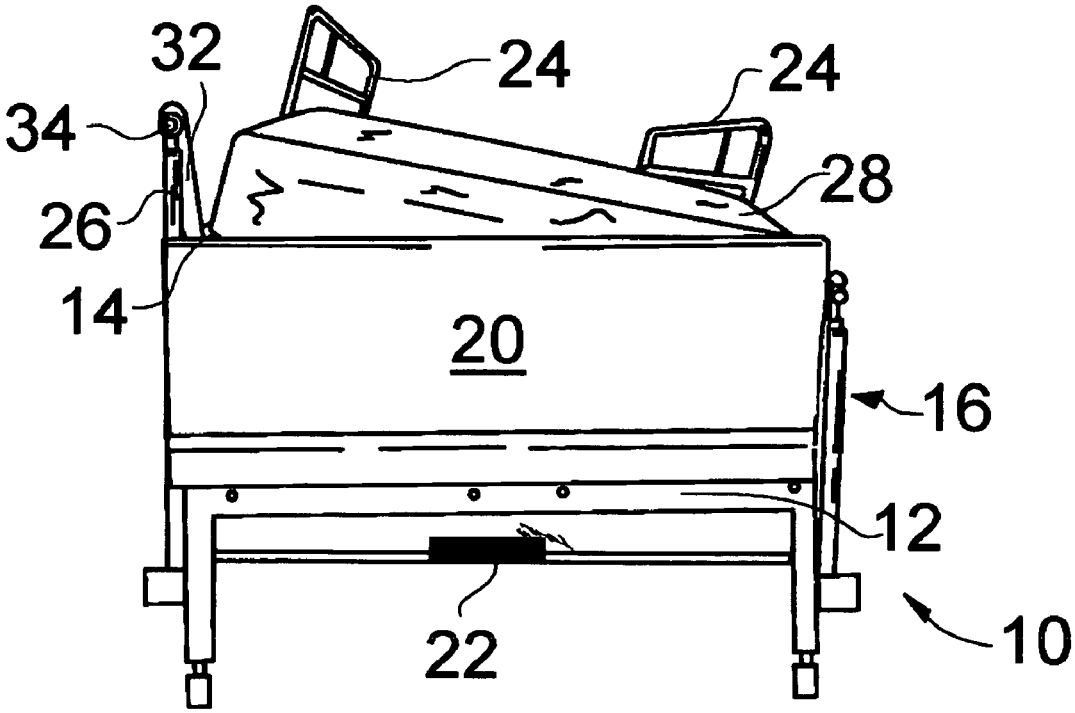

Referring now to FIG. 2A, the adjustable bed 10 comprising the headboard 18 has one side of the movable bed frame 14 elevated relative to the stationary bed frame 12 with one actuator device 16 in an extended position and one actuator device 16 in a retracted position. The power supply 22 is located on a lower portion of the stationary bed frame 12. Referring to FIG. 2A, the bracket 32 is shown coupled to the joint coupler 34 of the actuator 26 on the elevated side of the adjustable bed 10. FIG. 2B shows the footboard 20 of the adjustable bed 10 with one side of the movable bed frame 14 elevated relative to the stationary bed frame 12 and with one actuator device 16 in an extended position and one actuator device 16 in a retracted position. In both FIGS. 2A and 2B, the mattress 28 is located on the movable bed frame 14 and a safety rail 24 is located on a side and on an opposite side of the movable bed frame 14.

Figure 3:
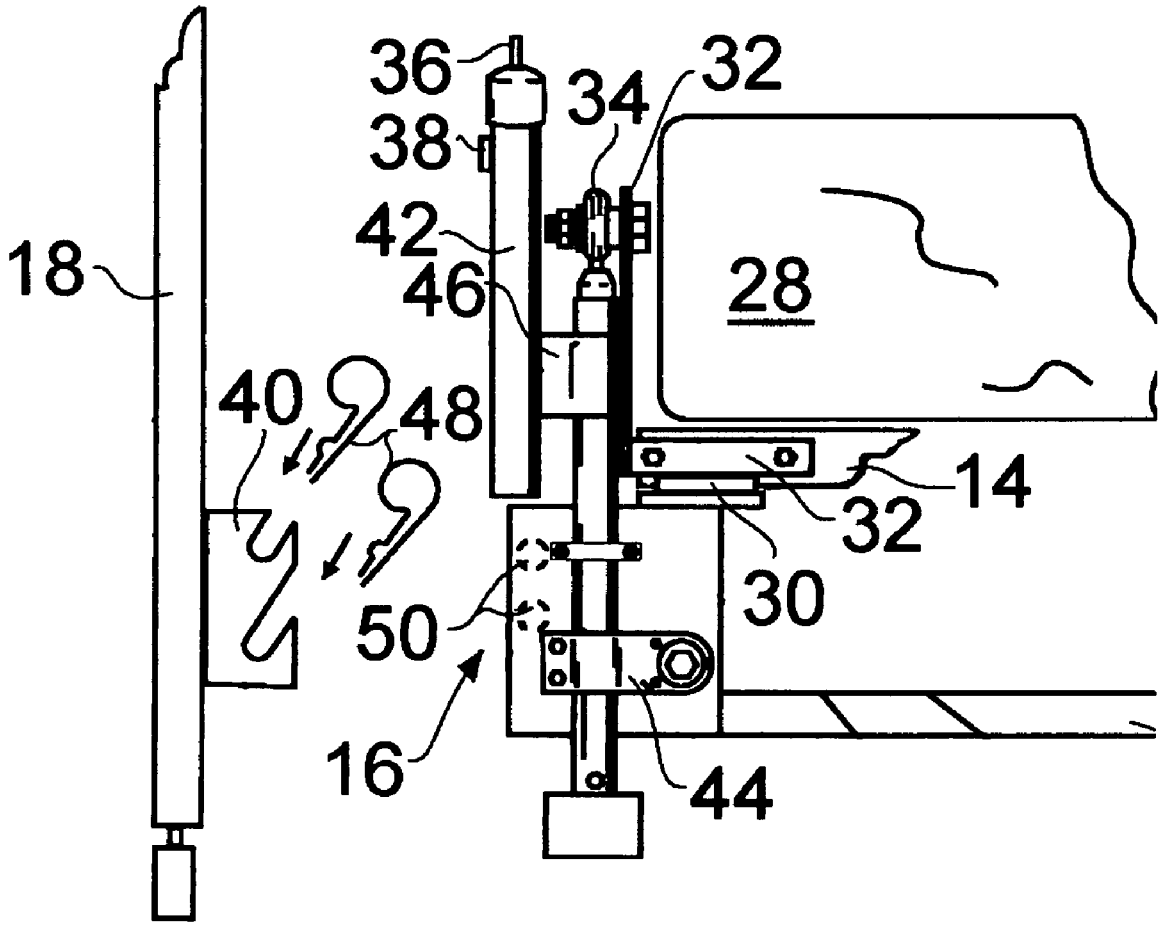
FIG. 3 is a perspective view showing an exploded side view of a portion of one actuator device of FIG. 1, and a portion of the stationary bed frame positioned to couple to a portion of the headboard of the adjustable bed.

FIG. 3 shows an exploded side view of a portion of one actuator device 16 of the adjustable bed 10 with a portion of the actuator device 16 coupled to a portion of the stationary bed frame 12 and a portion of the actuator device 16 further coupled to a portion of the movable bed frame 14. Furthermore, in FIG. 3 a portion of the stationary bed frame 12 is positioned to couple to a portion of the headboard 18 of the adjustable bed 10. The actuator device 16 comprises the actuator 26 having the joint coupler 34 located at one end of the actuator 26. The switching cylinder 42 comprises the toggle switch 36 and the safety switch 38 located on a portion of the switching cylinder 42 and a portion of the switching cylinder 42 is coupled to a portion of the actuator 26 (see FIG. 4, described below). A lower mount 44 and an upper mount 46 securely couple the actuator device 16 to a portion of the stationary bed frame 12. One end of the bracket 32 is coupled to the joint coupler 34 of the actuator 26 and the opposite end of the bracket 32 is coupled to a portion of the movable bed frame 14. The opposite end of the bracket 32 of the movable bed frame 14 rests on a bearing 30 of a portion of the stationary bed frame 12 when the movable bed frame 14 is in a non-elevated position. The bearing 30 may comprise a plastic such as polypropylene and the like. The mattress 28 is located on a portion of the movable bed frame 14. The headboard 18 comprises a headboard bracket 40 having at least one slot. A portion of the stationary bed frame 12 comprises at least one stud 50 to receive the slot of the headboard bracket 40. At least one retainer 48 securely couples the slot of the headboard bracket 40 to the stud 50. As shown in FIG. 3 the retainer 48 is a spring clip. Without limiting the scope of the present disclosure, it is understood that the combination of the retainer 48 and the stud 50 may be replaced by fasteners such as screws, nuts and bolts, welds and the like to couple a portion of the headboard 18 to a portion of the stationary bed frame 12.

Figure 4:
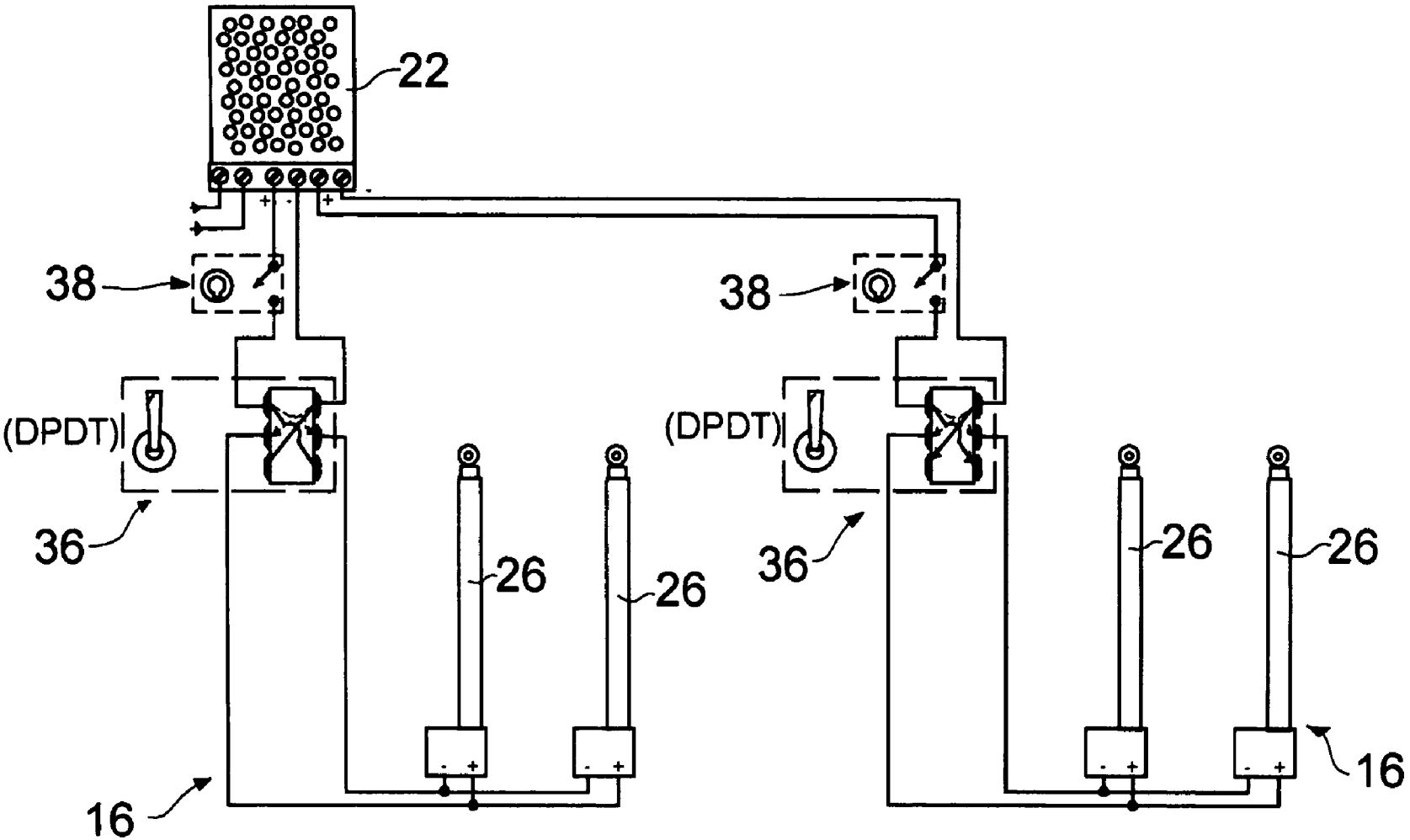
FIG. 4 is a schematic of a wiring diagram showing a first pair of actuators coupled to a first double-pole-double throw (DPDT) switch, a second pair of actuators coupled to a second DPDT switch, the first DPDT switch being coupled to a first safety switch and the second DPDT switch being coupled to a second safety switch, and with the actuators powered by a DC power supply in accordance with this invention.

Turning now to FIG. 4, a schematic of a wiring diagram shows a first actuator device 16 and a second actuator device 16 powered by a DC power supply 22. The first actuator device 16 further comprises a first pair of actuators 26 and the second actuator device 16 further comprises a second pair of actuators 26. The first pair of actuators 26 is coupled to a first double-pole-double throw (DPDT) toggle switch 36 and the second pair of actuators 26 is coupled to a second DPDT toggle switch 36. The first DPDT toggle switch 36 is coupled to a first safety switch 38 and the second DPDT toggle switch 36 is coupled to a second safety switch 38. As shown in FIG. 4, the DC power supply 22 is coupled to an AC power source. However, as described above, the DC power supply 22 may be any type of power supply without limiting the scope of the current disclosure. If the double-pole-double throw (DPDT) toggle switch 36 completes a circuit in a first position of the toggle switch 36, current flows from the power supply 22 to both of the actuators 26 of one of the actuator devices 16 thereby resulting in elevation of both of the first pair of actuators 26. In a second position of the double-pole-double throw (DPDT) toggle switch 36, retraction of both of the actuators 26 is achieved by completing a circuit flowing from the power supply 22. A third position of the double-pole-double throw (DPDT) toggle switch 36 results in no circuit completion (neutral position) to stop any current flow to both of the actuators 26. The safety switch 38 has a first position for completing current flow from the power supply 22 to both of the actuators 26 and a second position to stop current flow from the power supply 22.

Exemplary Method for Safely Moving a Person from a Side of a Bed to a Second Side of the Bed A method for safely moving a person from a side of a bed to a second side of the bed comprises a number of steps. The method comprises the steps of providing an adjustable bed 10 comprising a first bed frame 12 and a second bed frame 14. The adjustable bed 10 comprises a plurality of actuator devices 16, a portion of the first bed frame 12 is coupled to a portion of each one of the actuator devices 16 and a portion of the second bed frame 14 is coupled to a portion of each one of the actuator devices 16. The adjustable bed 10 comprises a power supply 22 coupled to the actuator devices 16 to selectively elevate a side of the second bed frame 14 thereby relocating a person resting on a mattress 28 located on the second bed frame 14 transversely from a first side to a second side of the mattress 28. The method further comprises the step of providing at least one safety rail 24 coupled to a portion of the second bed frame 14 to prevent the person from rolling off the mattress 28 when powering at least one actuator device 16 of the actuator devices 16. The method further comprises the step of providing a headboard 18 and a footboard 20, both a portion of the headboard 18 and a portion of the footboard 20 coupled to a portion of the first bed frame 12 to confine the person safely between the headboard and the footboard when elevating a side of the second bed frame 14. The method further comprises the steps of providing at least one actuator device 16 having a safety switch 38 and unlocking the safety switch 38 by a caregiver to selectively activate an actuator 26 of the at least one actuator device 16 in preparation for elevating a side of the second bed frame 14. The method further comprises the step of providing the at least one actuator device 16 has a toggle switch 36 to selectively elevate and lower a side of the second bed frame 14 relative to the first bed frame 12.

With regard to actions of the caregiver, the caregiver places a pillow against the at least one safety rail 24 located on an opposite side of the second bed frame 14. The caregiver flips the toggle switch 36 to a first position to provide power to the at least one actuator device 16 to elevate the side of the second bed frame 14. The caregiver guides the person when elevating the side of the second bed frame 14 to maintain control over rolling movement of the person. The person resting on the mattress 28 is relocated transversally from a first side to a second side of the mattress 28 thereby permitting convenient access by the caregiver to a previously inaccessible portion of the person. The caregiver flips the toggle switch 36 to a second position to deactivate the at least one actuator device 16.

The caregiver flips the toggle switch 36 to a third position to provide power to at least one actuator device 16 to lower the side of the second bed frame 14 and guides the person when lowering the side of the second bed frame 14 to maintain control over rolling movement of the person. The person resting on the mattress 28 is relocated transversally from the second side to the first side of the mattress 28. The caregiver flips the toggle switch 36 to the second position to deactivate the at least one actuator device 16. The caregiver locks the safety switch 38 to prevent unauthorized access to the actuator devices 16.

While the invention has been particularly shown and described with reference to preferred embodiments thereof, it will be understood by those skilled in the art that the foregoing and other changes in form and details may be made therein without departing from the spirit and scope of the invention. For example, the adjustable bed may additionally be capable of longitudinal motion, so that the upper body of a person or the lower body of the person may be separately elevated or lowered. The stationary bed frame of the adjustable bed may comprise a plurality of wheels.

What is claimed is:

1. An adjustable bed comprising, in combination:

(a) a first bed frame and a second bed frame;

(b) a plurality of actuator devices located substantially between a side of said first bed frame and a side of said second bed frame, said plurality of actuator devices further located substantially between an opposite side of said first bed frame and an opposite side of said second bed frame, a portion of said side of said first bed frame coupled to a portion of at least one of said plurality of actuator devices and a portion of said side of said second bed frame coupled to a portion of said at least one of said plurality of actuator devices, a portion of said opposite side of said first bed frame coupled to a portion of at least another of said plurality of actuator devices and a portion of said opposite side of said second bed frame coupled to a portion of said at least another of said plurality of actuator devices, each of said plurality of actuator devices configured to move independently of any other of said plurality of actuator devices, at least one of the actuator devices comprising a toggle switch, the ends of the first and the second bed frames lacking actuator devices; and (c) a power supply coupled to said plurality of actuator devices providing power to selectively elevate at least one of said side and said opposite side of said second bed frame thereby relocating a person resting on a mattress located on said second bed frame transversely from a first side to a second side of said mattress.

2. The bed according to claim 1 further comprising at least one safety rail coupled to a portion of said second bed frame to prevent said person from rolling off said mattress when powering at least one actuator device of said plurality of actuator devices.

3. The bed according to claim 1 further comprising a headboard and footboard, both a portion of said headboard and a portion of said footboard coupled to a portion of said first bed frame to confine said person safely between said headboard and said footboard when elevating a side of said second bed frame.

4. The bed according to claim 1 wherein each one of said plurality of actuator devices comprising an actuator.

5. The bed according to claim 4 further comprising a plurality of brackets, an end of each of said plurality of brackets coupled to a portion of each actuator of said plurality of actuator devices and a portion of said second bed frame coupled to an opposite end of each of said plurality of brackets.

6. The bed according to claim 1 wherein at least one actuator device comprises a safety switch to prevent unauthorized use of said at least one actuator device.

7. The bed according to claim 1 wherein said first bed frame is stationary and said second bed frame is movable relative to said first bed frame.

8. The bed according to claim 1 wherein each of said plurality of actuator devices selectively elevates said side of said second bed frame no greater than about eighteen inches.

9. An adjustable bed comprising, in combination:

(a) a stationary bed frame and a movable bed frame;

(b) a first pair of actuator devices located on a side of said adjustable bed and a second pair of actuator devices located on an opposite side of said adjustable bed, a portion of a side of said stationary bed frame coupled to a portion of said first pair of actuator devices and a portion of a side of said movable bed frame coupled to a portion of said first pair of actuator devices and an opposite side of said stationary bed frame coupled to a portion of said second pair of actuator devices and a portion of an opposite side of said movable bed frame coupled to a portion of said second pair of actuator devices, each of said actuator devices configured to move independently of any other of said actuator devices, at least one of the actuator devices comprising a toggle switch, the ends of the and the second bed frames lacking actuator devices; and (c) a power supply coupled to at least one of said first pair of actuator devices and to at least one of said second pair of actuator devices providing power to selectively elevate at least one of said side and said opposite side of said movable bed frame thereby relocating a person resting on a mattress located on said movable bed frame transversely from a first side to a second side of said mattress.

10. The bed according to claim 9 wherein a first actuator of said first pair of actuator devices is coupled to a second actuator of said first pair of actuator devices, both said first actuator and said second actuator elevating said movable bed frame when activated by said power supply.

11. The bed according to claim 9 further comprising at least one safety rail coupled to a portion of said movable bed frame to prevent said person from rolling off said mattress when powering at least one actuator device of said first pair and said second pair of actuator devices.

12. The bed according to claim 9 further comprising a headboard and footboard, both a portion of said headboard and a portion of said footboard coupled to a portion of said stationary bed frame to confine said person safely between said headboard and said footboard when elevating a side of said movable bed frame.

13. The bed according to claim 9 wherein at least one actuator device of both said first pair and said second pair of actuator devices comprises a safety switch, selectively elevating and lowering a side of said second bed frame relative to said first said safety switch preventing unauthorized use of both said first pair and said second pair of actuator devices.

14. The bed according to claim 9 further comprising a plurality of brackets, an end of each of said plurality of brackets coupled to a portion of each actuator of said first pair and said second pair of actuator devices and a portion of said second bed frame coupled to an opposite end of each of said plurality of brackets.

15. A method for safely moving a person from a side of a bed to a second side of the bed comprising the steps of:

(a) providing an adjustable bed comprising a first bed frame and a second bed frame;

(b) providing said adjustable bed comprising a plurality of actuator devices located substantially between a side of said first bed frame and a side of said second bed frame, said plurality of actuator devices further located substantially between an opposite side of said first bed frame and an opposite side of said second bed frame, a portion of said side of said first bed frame coupled to a portion of at least one of said plurality of actuator devices and a portion of said side of said second bed frame coupled to a portion of said at least one of said plurality of actuator devices, a portion of said opposite side of said first bed frame coupled to a portion of at least another of said plurality of actuator devices and a portion of said opposite side of said second bed frame coupled to a portion of said at least another of said plurality of actuator devices, each of said plurality of actuator devices configured to move independently of any other of said plurality of actuator devices, at least one of the actuator devices comprising a toggle switch, the ends of the first and the second bed frames lacking actuator devices; and (c) providing said adjustable bed comprising a power supply coupled to said plurality of actuator devices to selectively elevate at least one of said side and said opposite side of said second bed frame thereby relocating a person resting on a mattress located on said second bed frame transversely from a first side to a second side of said mattress.

16. The method according to claim 15 further comprising the steps of:

(a) providing at least one safety rail coupled to a portion of said second bed frame to prevent said person from rolling off said mattress when powering at least one actuator device of said plurality of actuator devices; and (b) providing a headboard and a footboard, both a portion of said headboard and a portion of said footboard coupled to a portion of said first bed frame to confine said person safely between said headboard and said footboard when elevating a side of said second bed frame.

17. The method according to claim 15 further comprising the steps of:

(a) providing at least one actuator device having a safety switch; and (b) unlocking said safety switch by a caregiver to selectively activate an actuator of said at least one actuator device in preparation for elevating a side of said second bed frame.

18. The method according to claim 17 further comprising the steps of:

(a) placng a pillow by said caregiver against said at least one safety rail located on an opposite side of said second bed frame;

(b) flipping said toggle switch to a first position by said caregiver to provide power to said at least one actuator device to elevate said side of said second bed frame;

(c) guiding said person by said caregiver when elevating said side of said second bed frame to maintain control over rolling movement of said person;

(d) relocating said person resting on said mattress transversally from a first side to a second side of said mattress thereby permitting convenient access by said caregiver to a previously inaccessible portion of said person; and (e) flipping said toggle switch to a second position by said caregiver to deactivate said at least one actuator device.

19. The method according to claim 18 further comprising the steps of:

(a) flipping said toggle switch to a third position by said caregiver to provide power to said at least one actuator device to lower said side of said second bed frame;

(b) guiding said person by said caregiver when lowering said side of said second bed frame to maintain control over rolling movement of said person;

(c) relocating said person resting on said mattress transversally from said second side to said first side of said mattress;

(d) flipping said toggle switch to said second position by said caregiver to deactivate said at least one actuator device; and (e) locking said safety switch by said caregiver to prevent unauthorized access to said plurality of actuator devices.

* * * * *